US008121310B2

(12) United States Patent
Amada

(10) Patent No.: US 8,121,310 B2
(45) Date of Patent: Feb. 21, 2012

(54) SOUND RECEIVING APPARATUS AND METHOD

(75) Inventor: Tadashi Amada, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1073 days.

(21) Appl. No.: 12/014,473

(22) Filed: Jan. 15, 2008

(65) Prior Publication Data

US 2008/0199025 A1 Aug. 21, 2008

(30) Foreign Application Priority Data

Feb. 21, 2007 (JP) ..... 2007-041289

(51) Int. Cl.
*H04R 3/00* (2006.01)

(52) U.S. Cl. ..... 381/92; 381/95; 381/122

(58) Field of Classification Search ..... 381/92, 381/95, 122

See application file for complete search history.

(56) References Cited

U.S. PATENT DOCUMENTS 6,707,487 B1 * 3/2004 Aman et al. ..... 348/169
2009/0172773 A1 * 7/2009 Moore ..... 726/1

FOREIGN PATENT DOCUMENTS

JP 01-158374 6/1989
JP 2004-112701 4/2004

OTHER PUBLICATIONS

Office Action in JP 2007-0141289.
J. Oga et al., "Acoustic Systems and Digital Processing for Them," Coronasha, 1995 (in Japanese), pp. 180-187. Concise Explanation: Descriptions of Delay-and-sum algorithm.
N. Kikuma, "Adaptive Signal Processing with Array Antenna," Science and Technology Publishing Company, Inc., 1999 (in Japanese), pp. 86-93. Concise Explanation: Descriptions of DCMP algorithm.
L.J. Griffiths and C.W. Jim, "An Alternative Approach to Linearly Constrained Adaptive Beamforming," IEEE Trans. Antennas & Propagation, vol. AP-30, No. 1, Jan. 1982, pp. 27-34. Concise Explanation: Descriptions of Griffiths-Jim algorithm.
Y. Nagata et al., "Two-Channel Adaptive Microphone Array with Target Tracking," 'IEICA Trans., vol. 382-A, No. 6, 1999, pp. 860-866. Concise Explanation: Descriptions of two-channel adaptive microphone array algorithm.

* cited by examiner

*Primary Examiner* — Theresa T Doan
(74) *Attorney, Agent, or Firm* — Nixon & Vanderhye, P.C.

(57) ABSTRACT

A plurality of sound receiving units is installed onto an equipment body. An initial information memory stores an initial direction of the equipment body in a terminal coordinate system based on the equipment body. An orientation detection unit detects an orientation of the equipment body in a world coordinate system based on a real space. A lock information output unit outputs lock information representing to rock the orientation. An orientation information memory stores the orientation detected when the lock information is output. A direction conversion unit converts the initial direction to a target sound direction in the world coordinate system by using the orientation stored in the orientation information memory. A directivity forming unit forms a directivity of the plurality of sound receiving units toward the target sound direction.

18 Claims, 12 Drawing Sheets

SOUND RECEIVING APPARATUS AND METHOD

CROSS-REFERENCE TO RELATED APPLICATIONS

This application is based upon and claims the benefit of priority from prior Japanese Patent Application No. 2007-41289, filed on Feb. 21, 2007; the entire contents of which are incorporated herein by reference.

FIELD OF THE INVENTION

The present invention relates to a sound receiving apparatus and a method for determining a directivity of a microphone array of a mobile-phone.

BACKGROUND OF THE INVENTION

Microphone array technique is one of speech emphasis technique. Concretely, a signal received via a plurality of microphones is processed, and a directivity of the received signal is determined. Then, a signal from a direction along the directivity is emphasized while suppressing another signal.

For example, delay-and-sum array as the simplest method is disclosed in "Acoustic Systems and Digital Processing for Them, J. Ohga et al., Corona Publishing Co. Ltd., April 1995". In this method, a predetermined delay is additionally inserted into a signal of each microphone. As a result, signals come from a predetermined direction are summed at the same phase and emphasized. On the other hand, signals come from other directions are weakened because their phases are different.

Furthermore, a method called "adaptive array" is also used. In this method, a filter coefficient is arbitrarily updated according to an input signal, and disturbance sounds come from various directions except for a target direction are electively removed. This method has high ability to suppress noise.

Recently, by installing this microphone onto a portable terminal such as a cellular-phone or a PDA, application to clearly catch user's voice becomes popular. In this case, it is an important problem that directivity is formed toward which direction. For example, in case of a cellular-phone, orientation of a user who speaks with the cellular-phone is already known. Accordingly, previous design that directivity is formed toward a direction of the user's mouth is correct.

However, for a mobile speech-to-speech translation device that a plurality of peoples input their voice, directivity should be suitably set to a target person who speaks at the moment.

In order to solve this problem, a terminal has a fixed direction of directivity, and a user moves the terminal in order to keep the directivity set to an appropriate speaker. For example, a reporter moves a microphone between himself and the other party in an interview. However, this method is very troublesome, and there is a possibility that a user cannot watch a screen of the terminal on a direction of the terminal. Furthermore, in case of PDA that orientation (angle) of the terminal changes during use, the user must operate the terminal with conscious of a fixed direction (directivity) of the terminal.

In this way, in case of a terminal having a microphone array that a plurality of speakers inputs their voice, the directivity should be set along a target sound direction which changes depending on various speakers. This operation is very troublesome, and the screen of the terminal cannot be viewed depending on directions of the terminal. Furthermore, in case that orientation of the terminal changes during utterance of different speakers, a directivity direction of the terminal is often shifted from a target sound direction.

SUMMARY OF THE INVENTION

The present invention is directed to a sound receiving apparatus and a method for constantly forming a directivity of a microphone of a terminal toward a predetermined direction while changing an orientation of the terminal.

According to an aspect of the present invention, there is provided an apparatus for receiving sound, comprising: an equipment body; a plurality of sound receiving units in the equipment body; an initial information memory configured to store an initial direction of the equipment body in a terminal coordinate system based on the equipment body; an orientation detection unit configured to detect an orientation of the equipment body in a world coordinate system based on a real space; a lock information output unit configured to output lock information representing to lock the orientation; an orientation information memory configured to store the orientation detected when the lock information is output; a direction conversion unit configured to convert the initial direction to a target sound direction in the world coordinate system by using the orientation stored in the orientation information memory; and a directivity forming unit configured to form a directivity of the plurality of sound receiving units toward the target sound direction.

According to another aspect of the present invention, there is also provided a method for receiving sound in an equipment body having a plurality of sound receiving units, comprising: storing an initial direction of the equipment body in a terminal coordinate system based on the equipment body; detecting an orientation of the equipment body in a world coordinate system based on a real space; outputting lock information representing to lock the orientation; storing the orientation detected when the lock information is output; converting the initial direction to a target sound direction in the world coordinate system by using the orientation stored; and forming a directivity of the plurality of sound receiving units toward the target sound direction.

According to still another aspect of the present invention, there is also provided a computer readable medium storing program codes for causing a computer to receive sound in an equipment body having a plurality of sound receiving units, the program codes comprising: a first program code to store an initial direction of the equipment body in a terminal coordinate system based on the equipment body; a second program code to detect an orientation of the equipment body in a world coordinate system based on a real space; a third program code to output lock information representing to lock the orientation, a fourth program code to store the orientation detected when the lock information is output; a fifth program code to convert the initial direction to a target sound direction in the world coordinate system by using the orientation stored; and a sixth program code to form a directivity of the plurality of sound receiving units toward the target sound direction.

DETAILED DESCRIPTION OF THE EMBODIMENTS

Figure 1:
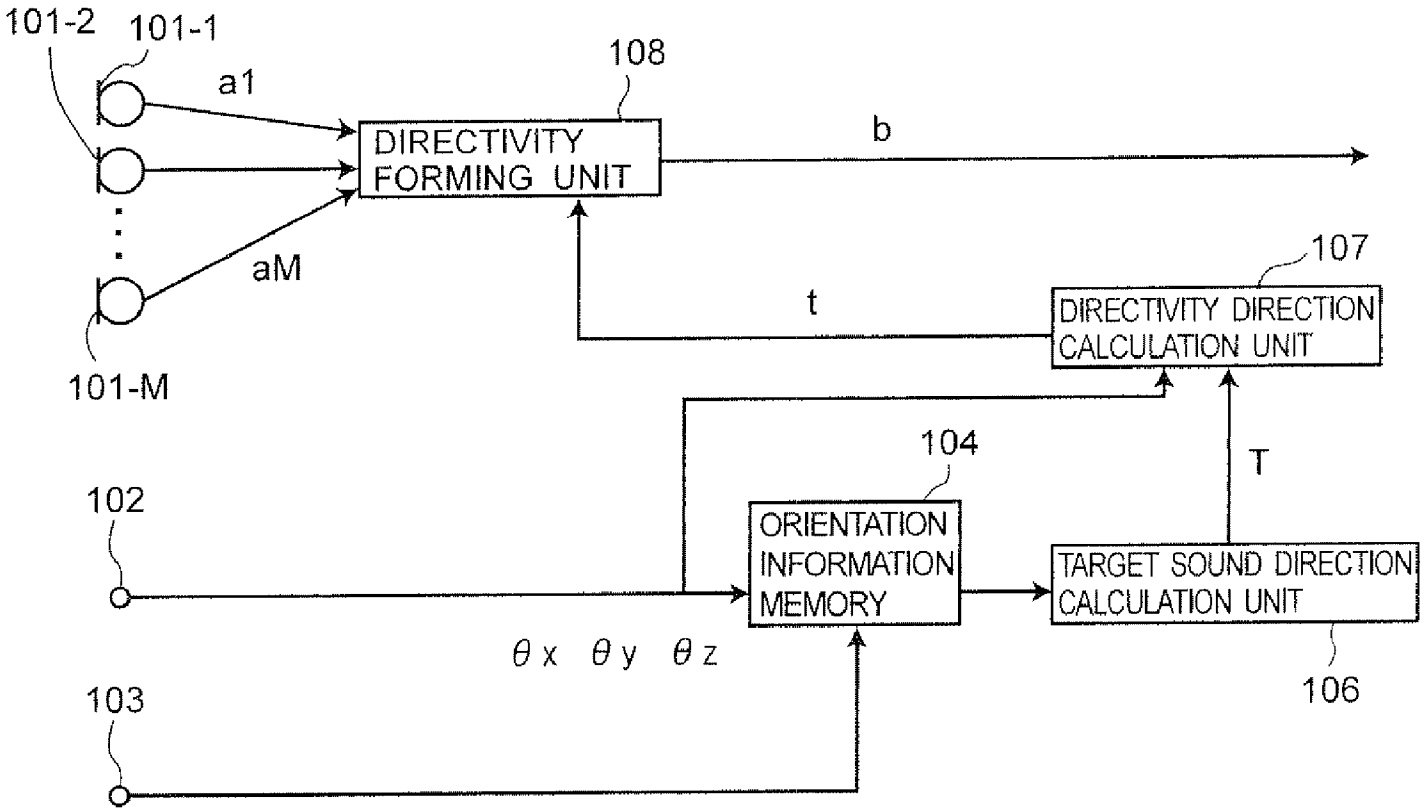
FIG. 1 is a block diagram of a sound receiving apparatus according to a first embodiment.

Hereinafter, various embodiments of the present invention will be explained by referring to the drawings. The present invention is not limited to the following embodiments.

First Embodiment

A sound receiving apparatus 100 of a first embodiment of the present invention is explained by referring to FIGS. 1, 6 and 7.

(1) COMPONENT OF THE SOUND RECEIVING APPARATUS 100

FIG. 1 is a block diagram of the sound receiving apparatus 100 of the first embodiment. The sound receiving apparatus 100 includes microphones 101-1~M, input terminals 102 and 103, an orientation information memory 104, a target sound direction calculation unit 106, a directivity direction calculation unit 107, and a directivity forming unit 108. The input terminal 102 receives orientation information of an equipment body 105 (shown in FIGS. 6A, 6B and 6C) of the sound receiving apparatus 100. The input terminal 103 receives lock information representing timing to store the orientation information. The orientation information memory 104 stores the orientation information at the timing of the lock information. The target sound direction calculation unit 106 calculates a target sound direction based on the orientation information in a real space. The directivity direction calculation unit 107 determines directivity of the sound receiving apparatus 100 according to the orientation information and the target sound direction. The directivity forming unit 108 processes signals from the microphones 101-1~m using the directivity direction, and outputs a signal from the directivity direction. Unit 101~108 are packaged into the equipment body of a rectangular parallelepiped.

As the lock information, a user may push a lock button on the sound receiving apparatus 100. The lock button may be shared with a button to push at speech start timing. Furthermore, at the time when a speaker's utterance is necessary in cooperation with an application, the application may voluntarily supply a lock signal.

(2) OPERATION OF THE RECEIVING APPARATUS 100

Next, operation of the receiving apparatus 100 is explained.

First, orientation of the equipment body 105 of the sound receiving apparatus 100 is provided to the input terminal 102 on, for example, an hourly basis. The orientation of the equipment body 105 can be detected using a three axes acceleration sensor or a three axes magnetic sensor. These sensors are small-sized chips installed onto the sound receiving apparatus 100.

At the time when the lock information is provided to the input terminal 103, orientation of the equipment body 105 of the sound receiving apparatus 100 is stored in the orientation information memory 104.

The target sound direction calculation unit 106 calculates a target sound direction in real space by using an orientation of the equipment body 105 (of the sound receiving apparatus 100) and an initial direction preset on the equipment body 105. The initial direction is, for example, a long side direction of the equipment body 105 if the equipment body of the sound receiving apparatus 100 is a rectangular parallelepiped. The target sound direction is, for example, a ceiling direction if the long side direction (initial direction) turns to the ceiling when lock information is input.

The directivity direction calculation unit 107 decides which direction of the equipment body 105 is a target sound direction while the orientation of the equipment body 105 is changing, for example, hourly. In this case, the direction of the equipment body 105 is calculated using orientation information (output from the input terminal 102) and the target sound direction (output from target sound direction calculation unit 106). In the above example, the target sound direction is the ceiling direction but assume that the equipment body 105 of the sound receiving apparatus 100 is moved to a horizontal direction. In this case, a target sound direction viewed from the equipment body 105 is controlled as a direction vertical to the long side direction.

The directivity forming unit 108 forms a directivity to the target sound direction, and processes input signals from the microphones 101-1~M so that an input signal from the target sound direction is emphasized.

(3) EXAMPLE

(3-1) A First Example

Figure 6C:
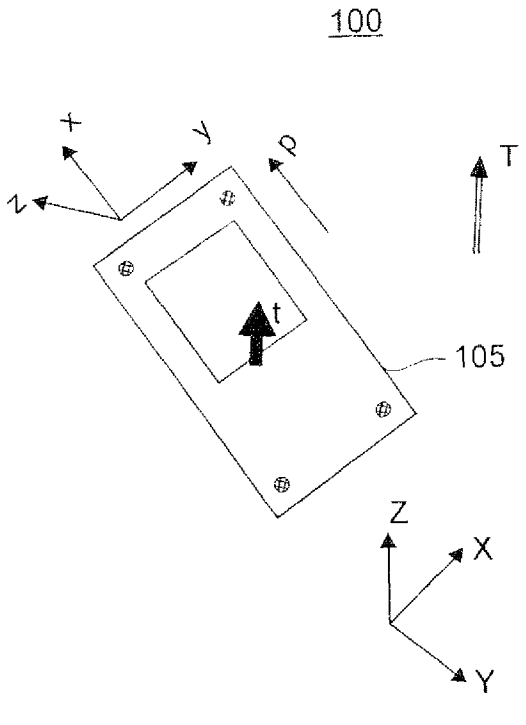
FIGS. 6A, 6B and 6C are schematic diagrams showing relationship between orientation of a sound receiving apparatus and a target sound direction.
Figure 6B:
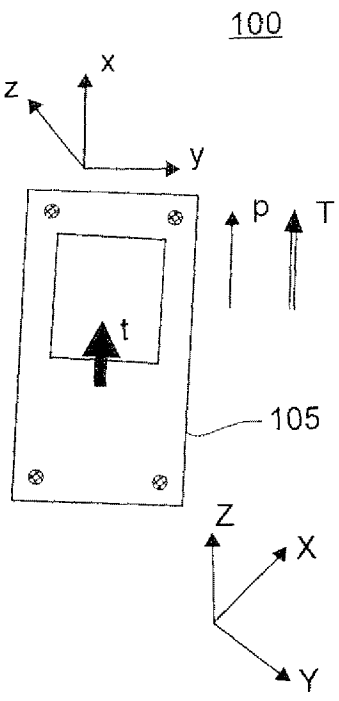
Figure 6A:
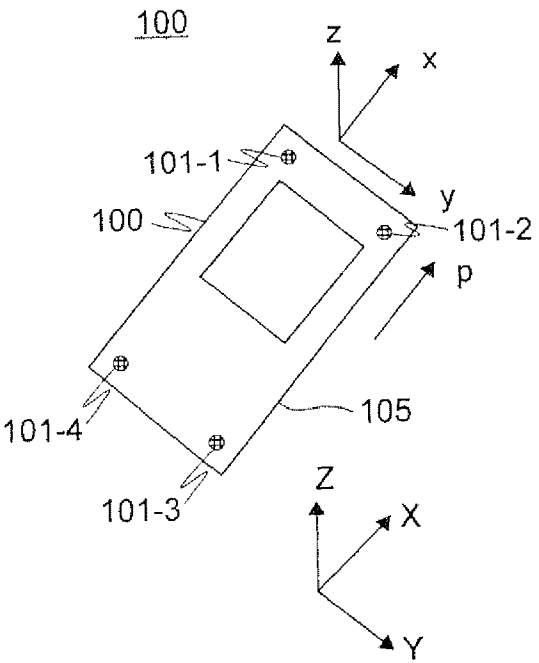

The first example of the first embodiment is explained using FIGS. 6A, 6B, and 6C. Microphones 101-1~4 are installed onto four corners of the equipment body 105 of the sound receiving apparatus 100. FIG. 6A shows relationship between the equipment body 105 of the sound receiving apparatus 100 and a real space at activation timing.

At the activation timing, an orientation of the equipment body is captured using a stored sensor. For example, in a world coordinate system that X axis is the south direction, Y axis is the west direction, and Z axis is the ceiling direction, an orientation of the equipment body 105 is represented as a rotation angle ($\theta x$, $\theta y$, $\theta z$) of each axis.

On the other hand, a terminal coordinate system fixed to the equipment body 105 exists. As shown in FIGS. 6A-6C, in the terminal coordinate system, x axis is a vertical direction (long side direction), y axis is a horizontal direction (short side direction), and z axis is a normal line direction. Furthermore, the initial direction is set as x axis direction, i.e., p=(1,0,0) in the terminal coordinate system.

Next, as shown in FIG. 6B, a user inputs lock information to the sound receiving apparatus 100 by operation after moving the equipment body 105. In response to the lock information, the sound receiving apparatus 100 sets the initial direction p (long side direction) to a target sound direction t in the terminal coordinate system. The target sound direction t is a directivity direction of the microphones 101-1~M of the sound receiving apparatus 100.

After locking the target sound direction t, the equipment body 105 is often moved. Accordingly, by converting the target sound direction t to the world coordinate system, the target sound direction t is fixed even if the equipment body 105 is moved.

Concretely, following coordinate conversion matrix from the terminal coordinate system to the world coordinate system is used.

$$T = RL * t \tag{1}$$
$$= RLz * RLy * RLx * t$$

In above equation (1), "*" represents product, and "RL" is 3×3 conversion matrix from a terminal coordinate to a world coordinate at lock timing. "RL" is represented as a product of rotation matrixes around x axis, y axis and z axis as follows.

$$RLx = \begin{pmatrix} 1 & 0 & 0 \\ 0 & \cos\phi x & \sin\phi x \\ 0 & -\sin\phi x & \cos\phi x \end{pmatrix} \tag{2}$$

$$RLy = \begin{pmatrix} \cos\phi y & 0 & -\sin\phi y \\ 0 & 1 & 0 \\ \sin\phi y & 0 & \cos\phi y \end{pmatrix} \tag{3}$$

$$RLz = \begin{pmatrix} \cos\phi z & \sin\phi z & 0 \\ -\sin\phi z & \cos\phi z & 0 \\ 0 & 0 & 1 \end{pmatrix} \tag{4}$$

In the above matrixes, (ϕx, ϕy, ϕz) is a rotation angle around each coordinate axis at lock timing.

FIG. 6C shows operation of the equipment body 105 after locking. A microphone array of the sound receiving apparatus 100 is controlled so that the directivity direction always turns to the target sound direction locked. Accordingly, while the orientation of the sound receiving apparatus is changing, it is important to decide which direction in the terminal coordinate system is the target sound direction.

A decision method is explained. A target sound direction t in the terminal coordinate system is calculated using a target sound direction T (stored at lock timing) and an orientation (θx, θy, θz) of the sound receiving apparatus 100 at present timing as follows.

$$t = inv(R) * T \tag{5}$$
$$= inv(Rz * Ry * Rx) * T$$
$$= inv(Rx) * inv(Ry) * inv(Rz) * T$$

In above equation (5), "R" is a conversion matrix from the terminal coordinate system to the world coordinate system, "inv(R)" is an inverse matrix of the matrix "R" (i.e., a conversion matrix from the world coordinate system to the terminal coordinate system), and "Rx, Ry, Rz" are rotation matrixes around each axis (i.e., (ϕx, ϕy, ϕz) in equations (2) (3) (4) is replaced with rotation angle (θx, θy, θz) of present orientation).

In this way, the target sound direction in the world coordinate system is stored, and converted to the terminal coordinate system by referring to the present orientation of the equipment body 105. As a result, irrespective of change of orientation of the equipment body 105, a target sound direction in the terminal coordinate system can be calculated.

(3-2) A Second Example

The second example is explained. In the first example, a target sound direction T is stored and converted to a terminal coordinate. However, by detecting a difference of orientation of the equipment body 105 between the present timing and the lock timing, a target sound direction t can be directly calculated, not using a target sound direction T. This example is explained by equation.

A coordinate conversion matrix at some timing after locking is represented as follows.

$$R = RL * Rd$$

In above equation, "RL" is a conversion matrix at lock timing (in the same way as the equation (1)), and "Rd" is a conversion matrix to calculate a difference of orientation after lock timing. A target sound direction t is represented as follows.

$$t = \mathrm{inv}(R)T$$
$$= \mathrm{inv}(RL * Rd)T$$
$$= \mathrm{inv}(Rd)\mathrm{inv}(RL)T$$
$$= \mathrm{inv}(Rd)p$$

Briefly, the target sound direction t is calculated using an initial direction p (stored at lock timing) and a conversion matrix Rd (representing a difference of orientation after the lock timing).

(3-3) A Third Example

As mentioned-above, methods to calculate relationship between a target sound direction t of a terminal coordinate and a target sound direction T of a world coordinate are considered. The first embodiment does not limit such method. Furthermore, as to a coordinate system in the first embodiment, a coordinate axis is defined as a left-handed coordinate system. However, it may be defined as a right-handed coordinate system that Z axis is set along an opposite direction.

Furthermore, in the equation (1), a target sound direction t is converted to a target sound direction T. However, the target sound direction T is converted to the target sound direction t. In this case, a rotation angle (θx, θy, θz) and signs in equations (2)~(4) often change, which is not an essential problem. Briefly, any one definition may be used.

(4) OPERATION OF THE DIRECTIVITY FORMING UNIT 108

Next, operation example of the directivity forming unit 108 in FIG. 1 is explained.

(4-1) A First Method

The directivity direction calculation unit 107 calculates a target sound direction t in the terminal coordinate system at the present timing. By using a microphone array, directivity (directivity direction) is formed toward the target sound direction.

As an example of Adaptive type array, Directionally Constrained Minimization of Power (DCMP) is disclosed in "Adaptive Signal Processing with Array Antenna, N. Kikuma, Science and Technology Publishing Company, Inc., 1999". In this case, by calculating a vector "c" of array along a directivity direction, an array weight w is calculated as follows.

$$w=\mathrm{inv}(Mxx)c/cH^{*}\mathrm{inv}(Mxx)c$$

In the above equation, "inv(Mxx)" is an inverse matrix of a correlation matrix Mxx among microphones, and "cH" is a complex conjugate transposition of "c".

In case of delay-and-sum array, the array weight is calculated as follows.

$$w=c/cH^{*}c$$

This equation represents signal-delaying so that a difference of arriving time of signals among each microphone 101 is "0" for a directivity direction.

Furthermore, weight prepared may be selected according to the directivity direction. For example, in case of two microphones, any one of following weights is used.

w=(1,0)' or (0,1)' (': transposition)

The above equation represents selection of any one from two microphones.

Selection basis is determined by relationship between directivity and microphones-array location. For example, a microphone located where an angle between a straight line of the microphones-array and the directivity direction is an acute angle is set as "1" of weight w. In case of using directivity microphone, a microphone that an angle between its directivity characteristic and a directivity direction is narrower is set as "1" of weight w.

By using the weight w (obtained as mentioned-above), signals a1~aM received at microphones 101-1~M are summed (weighted sum). A processed signal b having directivity same as target sound direction is obtained as follows.

$$b=wH^{*}a$$

$$a=(a1,a2,\ldots,aM)$$

$$w=(w'1,w'2,\ldots,w'M)$$

w'H: complex conjugate transposition of w'

Another method for forming directivity toward the target sound direction is proposed. In case of Adaptive type array, Griffiths-Jim type array is disclosed in "An Alternate Approach to Linearly Constrained Adaptive Beamforming, L. J. Griffiths and C. W. Jim, IEEE Trans. Antennas & Propagation, Vol. AP-30, No. 1, January 1982".

(4-2) A Second Method

Furthermore, by setting a predetermined tracking range (for example, ±20°) toward a target sound direction, a signal from the tracking range may be emphatically operated. This method is disclosed in "Two-Channel Adaptive Microphone Array with Target Tracking, Y. Nagata, The Institute of Electronics, Information and Communication Engineers, Transcription A, J82-A, No. 6, pp. 860-866, 1999". In this method, signal-emphasis within the tracking range is realized by tracking a target signal in combination with prior type algorithm.

Application of this algorithm to the directivity forming unit 108 of the first embodiment is effective. By setting a tracking range, an error from orientation detection of the equipment body 105 or a discrepancy from assumption that a sound source is not strictly a plane wave can be reduced.

As mentioned-above, various means for forming directivity are applicable. The first embodiment does not limit the method for forming directivity. Another prior technique can be used.

(5) USE METHOD

Figure 7B:
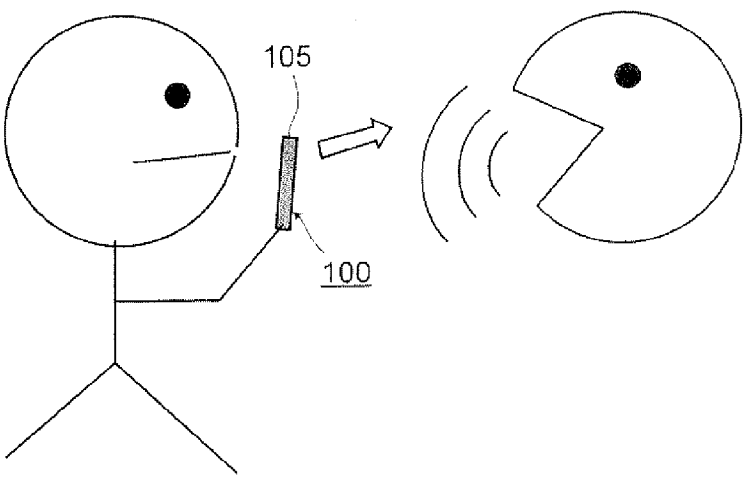
FIGS. 7A and 7B are schematic diagrams showing use status of the sound receiving apparatus according to the first embodiment.
Figure 7A:
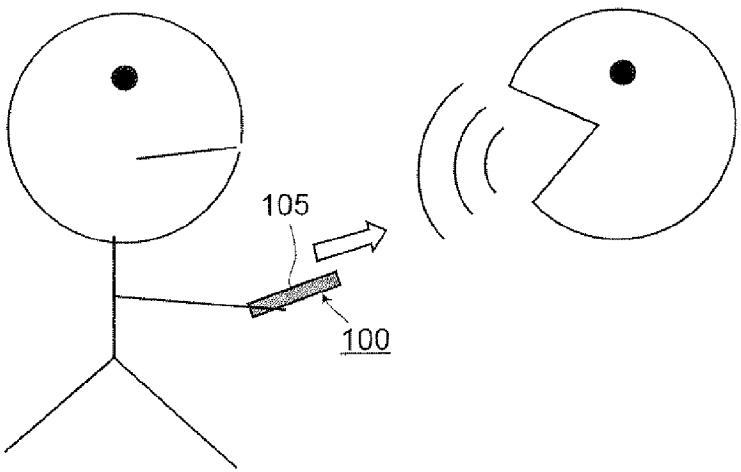

FIGS. 7A and 7B show schematic diagrams of using the sound receiving apparatus 100 of the first embodiment. In this example, two persons face each other, and the left side person has the equipment body 105 of the sound receiving apparatus 100.

As shown in FIG. 7A, in case of inputting the right side person's voice, the left side person pushes a lock button of the sound receiving apparatus 100 by pointing a long side direction of the equipment body 105 to the right side person. The long side direction of the equipment body 105 is already set as an initial direction. Accordingly, a target sound direction is set as an arrow in FIG. 7A.

Then, as shown in FIG. 7B, the left side person changes orientation of the equipment body 105 in order to watch a screen of the equipment body 105. In this case, the target sound direction is already fixed as an arrow direction toward the right side person. Accordingly, directivity of microphones-array of the sound receiving apparatus 100 is not shifted from the target sound direction.

Second Embodiment

Figure 2:
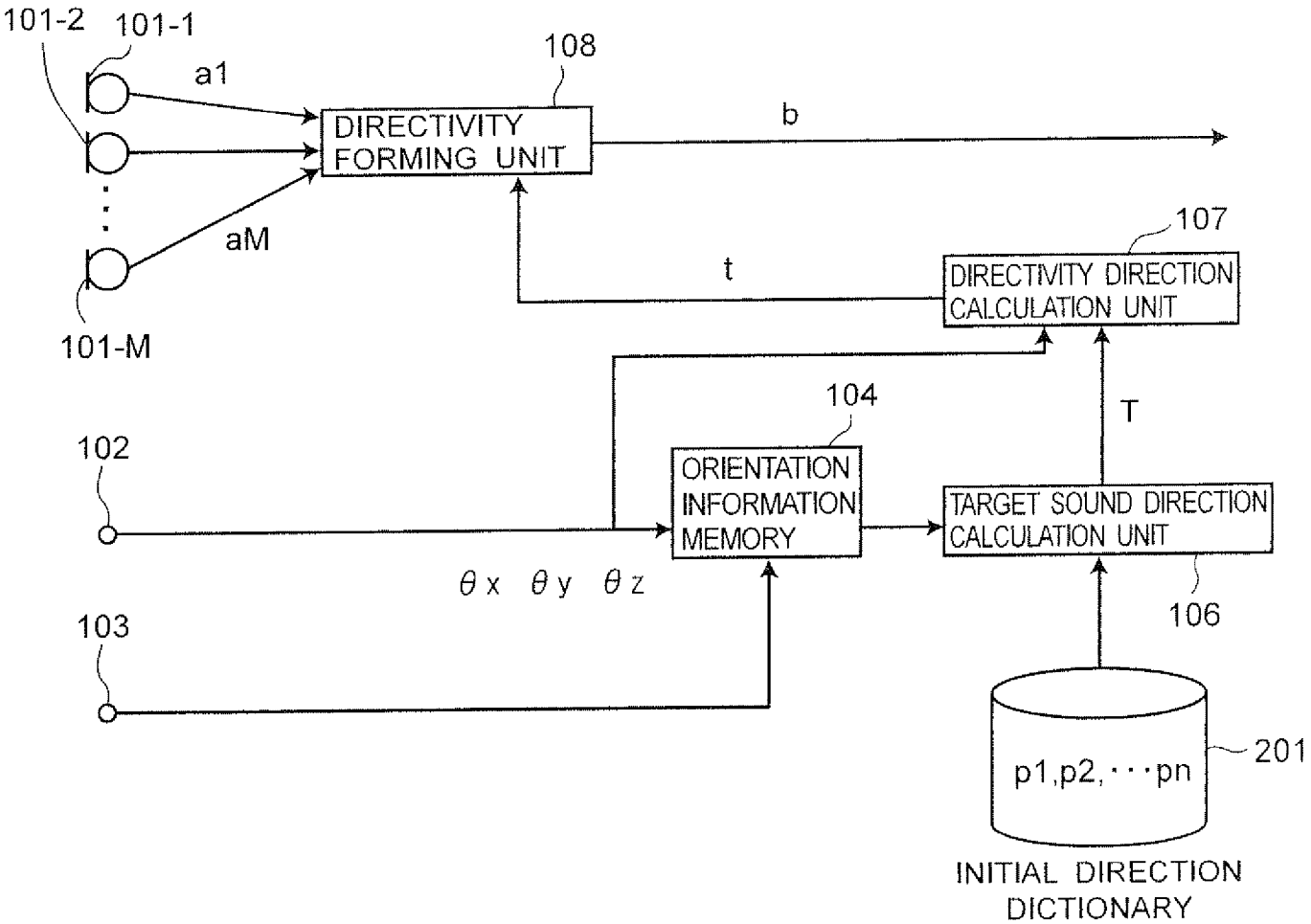
FIG. 2 is a block diagram of the sound receiving apparatus according to a second embodiment.
Figure 11:
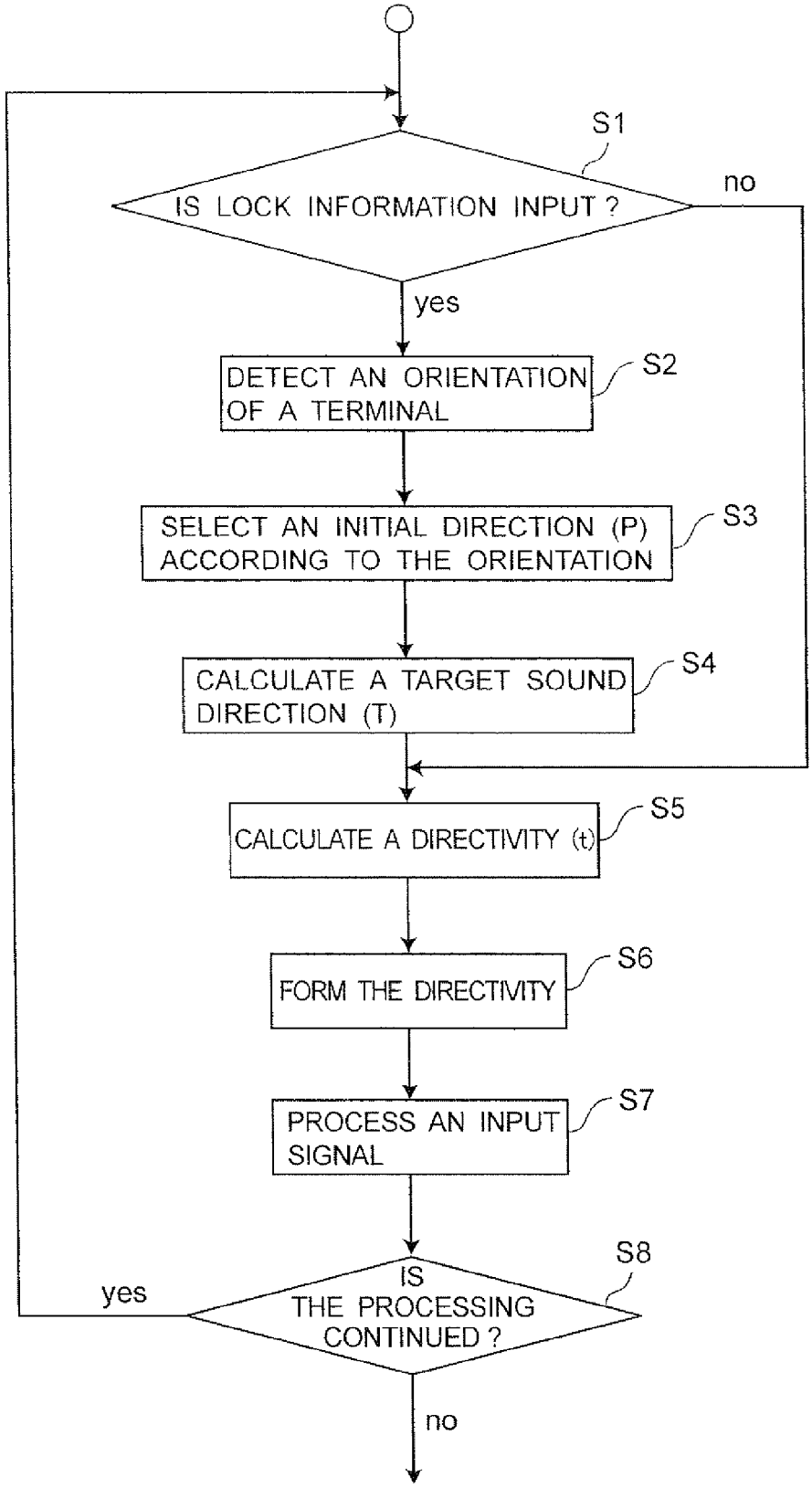
FIG. 11 is a flow chart of processing of the sound receiving method according to the second embodiment.

Next, the sound receiving apparatus 100 of the second embodiment is explained by referring to FIGS. 2, 8 and 11.

(1) Component of the Sound Receiving Apparatus 100:

FIG. 2 is a block diagram of the sound receiving apparatus 100 according to the second embodiment. A different feature of the second embodiment compared with the first embodiment is an initial direction dictionary 201. In the first embodiment, the initial direction is such as a long side direction of the equipment body 105. However, in the second embodiment, a plurality of initial directions are prepared and selected by output from the orientation information memory 104.

Figure 8B:
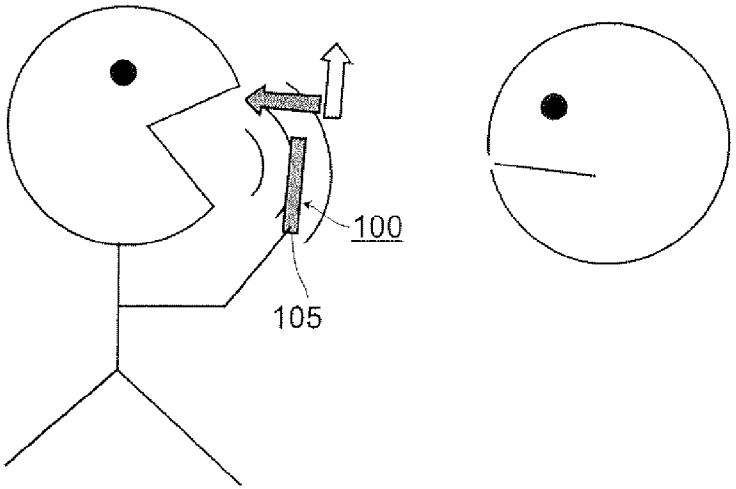
FIGS. 8A and 8B are schematic diagrams showing use status of the sound receiving apparatus according to the second embodiment.
Figure 8A:
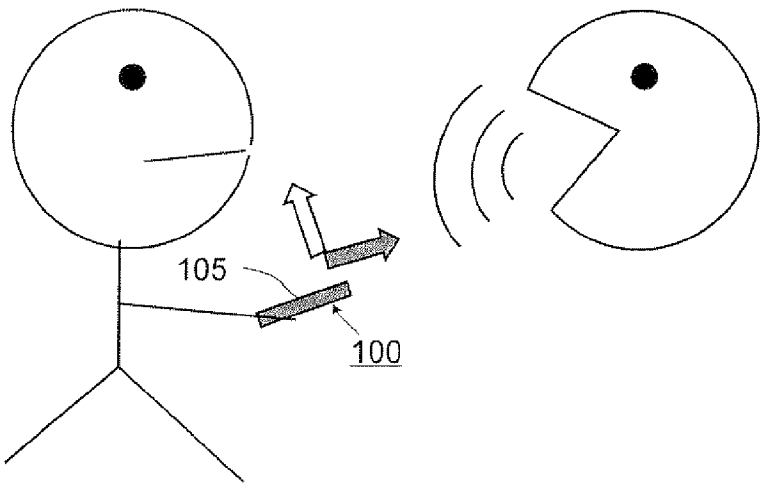

(2) Use Method:

A use method is explained by referring to FIGS. 8A and 8B. In this use method, the equipment body 105 of the sound receiving apparatus 100 has two initial directions, i.e., a long side direction and a normal line direction.

As shown in FIG. 8A, when the left side person pushes a lock button by laying the equipment body 105, the long side direction is selected as the initial direction, and a directivity direction is formed toward voice direction of the right side person.

On the other hand, as shown in FIG. 8B, when the left side person pushes a lock button by standing the equipment body 105, the normal line direction is selected as the initial direction, and a directivity direction is formed toward voice direction of the left side person (operator himself).

(3) Processing Method:

FIG. 11 is a flow chart of processing method of the second embodiment. At S1, it is decided whether lock information is input. In case of inputting the lock information, orientation of the equipment body 105 of the sound receiving apparatus 100 is detected at S2. At S3, an initial direction p is selected according to the orientation. At S4, the initial direction p is converted to a world coordinate, and a target sound direction T is calculated. At S5, a target sound direction t (directivity direction) in the terminal coordinate system is calculated according to the orientation of the equipment body 105.

At S6, parameter of microphones-array is set so that an input signal from the directivity direction is emphasized. At S7, the input signal is processed. Accordingly, a signal from the target sound direction is emphasized irrespective of orientation of the equipment body 105. At S8, it is decided whether processing is continued. In case of "no", processing is completed. In case of "yes", processing is forwarded to S1.

In case of "no" at S1, a target sound direction is not calculated, and processing is forwarded to S5. At S5, a present directivity direction p is calculated according to the target sound direction (previously calculated) and an orientation of the equipment body 105 of the sound receiving apparatus 100. In case of first processing of S1 as an exception, the processing waits until the lock information is input.

(4) Effect:

As mentioned-above, by setting a plurality of initial directions, even if an operator locates at 1800 direction from a long side direction of the equipment body 105 as shown in FIG. 8A, an angle for the operator to move the equipment body 105 to lock is only 90° as shown in FIG. 8B. As a result, the operator's usability improves.

Third Embodiment

Figure 3:
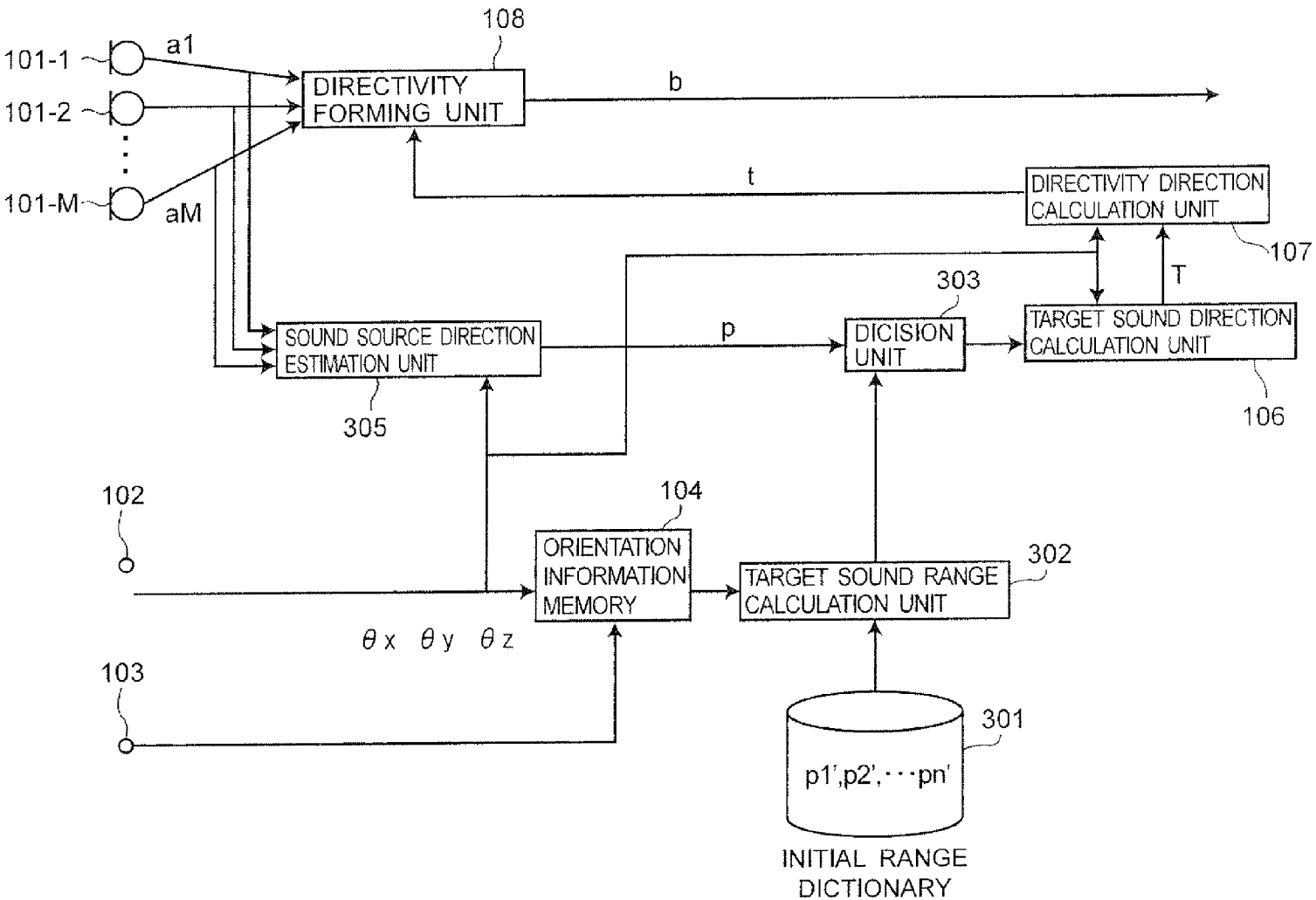
FIG. 3 is a block diagram of the sound receiving apparatus according to a third embodiment.

Next, the sound receiving apparatus 100 of the third embodiment is explained by referring to FIGS. 3 and 9. Different feature of the third embodiment compared with the second embodiment is an initial range dictionary 301 instead of the initial direction dictionary 201. In the second embodiment, an initial direction is selected in response to lock information. However, in the third embodiment, an initial range is selected.

(1) Component of the Sound Receiving Apparatus:

FIG. 3 is a block diagram of the sound receiving apparatus 100 according to the third embodiment. The sound receiving apparatus 100 includes microphones 101-1~M, input terminals 102 and 103, an orientation information memory 104, a target sound direction calculation unit 106, a directivity direction calculation unit 107, a directivity forming unit 108, an initial range dictionary, a target sound range calculation unit 302, a decision unit 303, and a sound source direction estimation unit 305.

The input terminal 102 receives orientation information of the equipment body 105 of the sound receiving apparatus 100. The input terminal 103 receives lock information representing timing to store the orientation information. The orientation information memory 104 stores the orientation information at the timing of the lock information. The initial range dictionary 301 stores a plurality of target sound ranges prepared. The target sound range calculation unit 302 selects a target sound range (initial range) from the initial range dictionary 301 according to output of the orientation information memory 104. The sound source direction estimation unit 305 estimates a sound source direction from signals input to the microphones 101-1~M. The decision unit 303 decides whether the sound source direction is within the target sound range (selected by the target sound range calculation unit 302), and outputs the sound source direction as the initial direction when the sound source direction is within the target sound range.

The target sound direction calculation unit 106 calculates a target sound direction according to the decision result (from the decision unit 303) and the orientation information (from the input terminal 102). The directivity direction calculation unit 107 determines directivity of the sound receiving apparatus 100 according to output from the target sound direction calculation unit 106. The directivity forming unit 108 processes signals from the microphones 101-1~m using the directivity direction, and outputs a signal from the directivity direction.

(2) Operation of the Sound Receiving Apparatus 100:

Next, operation of the sound receiving apparatus 100 of the third embodiment is explained. When an operator locks the sound receiving apparatus 100 by directing the equipment body 105 to a speaker, an initial direction of the equipment body 105 is often shifted from the speaker's direction. Accordingly, instead of the initial direction, an initial range having a small space centered around the initial direction (For example, ±20° from a long side direction of the equipment body 105) is set.

Then, the sound source direction estimation unit 305 estimates an utterance direction of the speaker (the equipment body 105 is directed), and sets the utterance direction as the initial direction. The target sound direction calculation unit 106 calculates a target sound direction according to the initial direction, and the directivity is formed in the same way as in the second embodiment.

In this case, in a period from set timing of the initial range to utterance timing of the speaker, noise often comes from another direction. The decision unit 303 decides whether a sound source direction is within the initial range. If the sound source direction is not within the initial range, a target sound direction is not calculated.

Figure 9B:
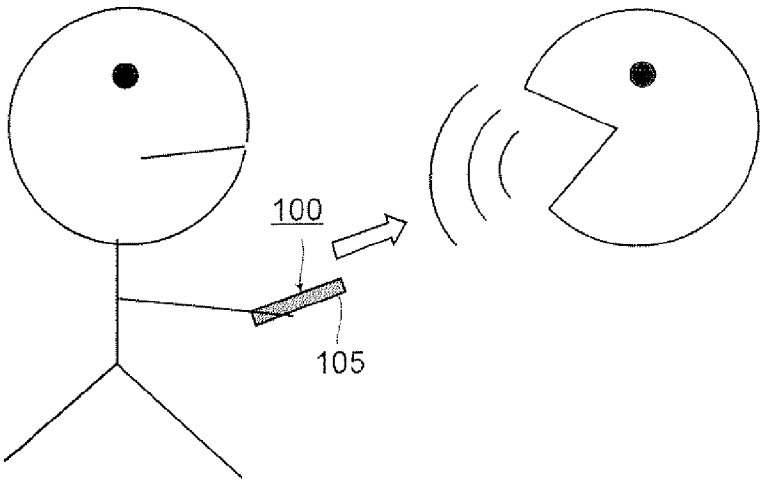
FIGS. 9A and 9B are schematic diagrams showing use status of the sound receiving apparatus according to the third embodiment.
Figure 9A:
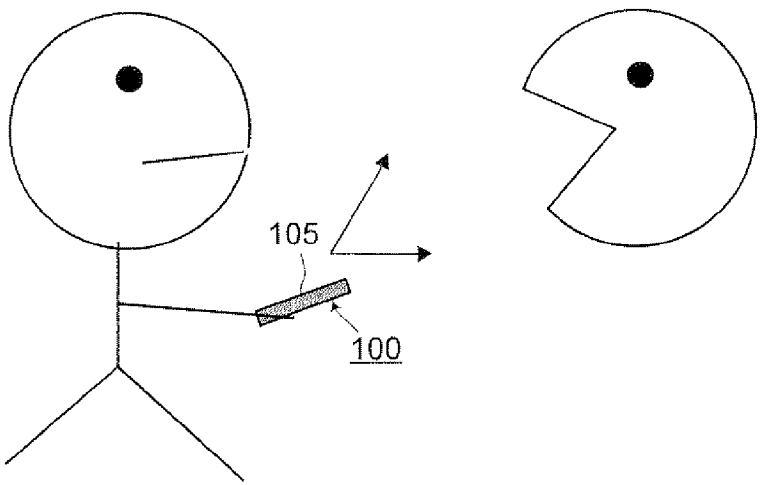

(3) Use Method:

FIGS. 9A and 9B are schematic diagrams of use situation of the sound receiving apparatus 100 according to the third embodiment. As show in FIG. 9A, an initial range (represented by two arrows) for the other party (speaker) is set. Next, as shown in FIG. 9B, an initial direction in the initial range is determined based on an utterance direction of the speaker. The initial direction is regarded as a target sound direction. Under this component, the initial direction need not be strictly directed to the speaker. In other words, the initial direction may be roughly directed to the speaker.

Fourth Embodiment

Figure 4:
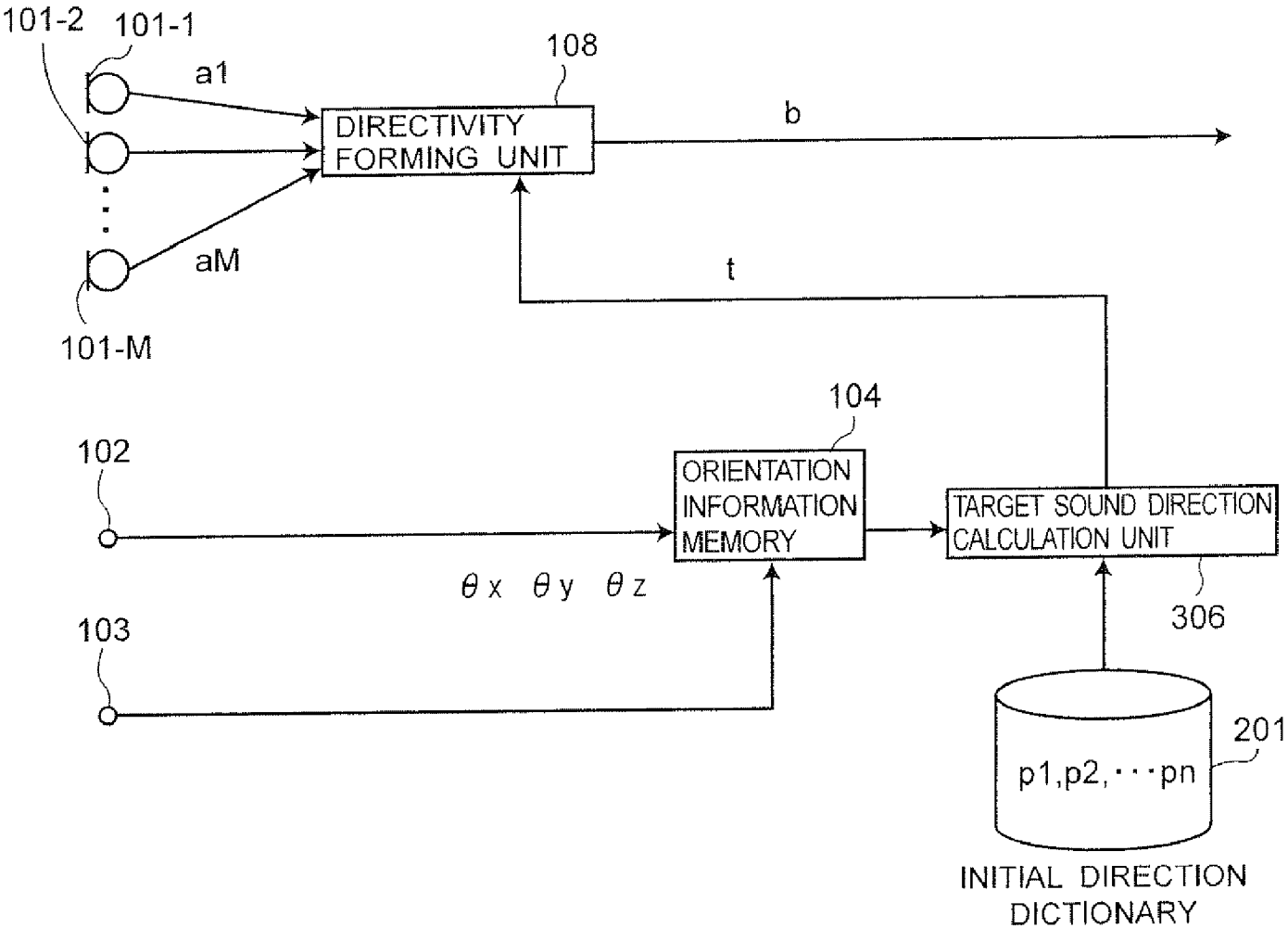
FIG. 4 is a block diagram of the sound receiving apparatus according to a fourth embodiment.

Next, the sound receiving apparatus 100 of the fourth embodiment is explained by referring to FIG. 4. FIG. 4 is a block diagram of the sound receiving apparatus 100 according to the fourth embodiment. The fourth embodiment does not include the directivity direction calculation unit 107 of the second embodiment. Furthermore, output from the target sound direction calculation unit 306 is directly supplied to the directivity forming unit 108.

In the second embodiment, a target sound direction t (input to the directivity forming unit 108) in the terminal coordinate space is calculated by the equation (5). This calculation is occasionally executed based on a rotation angle ($\theta x$, $\theta y$, $\theta z$) of a present orientation. On the other hand, if a target sound direction "t" does not change largely, a value "t" occasionally calculated by the present orientation ($\theta x$, $\theta y$, $\theta z$) is not so different from a value "t" calculated by a rotation angle ($\phi x$, $\phi y$, $\phi z$) at lock timing. In the fourth embodiment, a target sound direction "t" is fixed at the lock timing. As a result, subsequent occasional calculation is not necessary.

The fourth embodiment is unsuitable for the case that orientation of the equipment body 105 changes largely after locking. However, in case that the orientation does not change largely, the target sound direction "t" need not occasionally update, and calculation quantity can be reduced.

Fifth Embodiment

Figure 5:
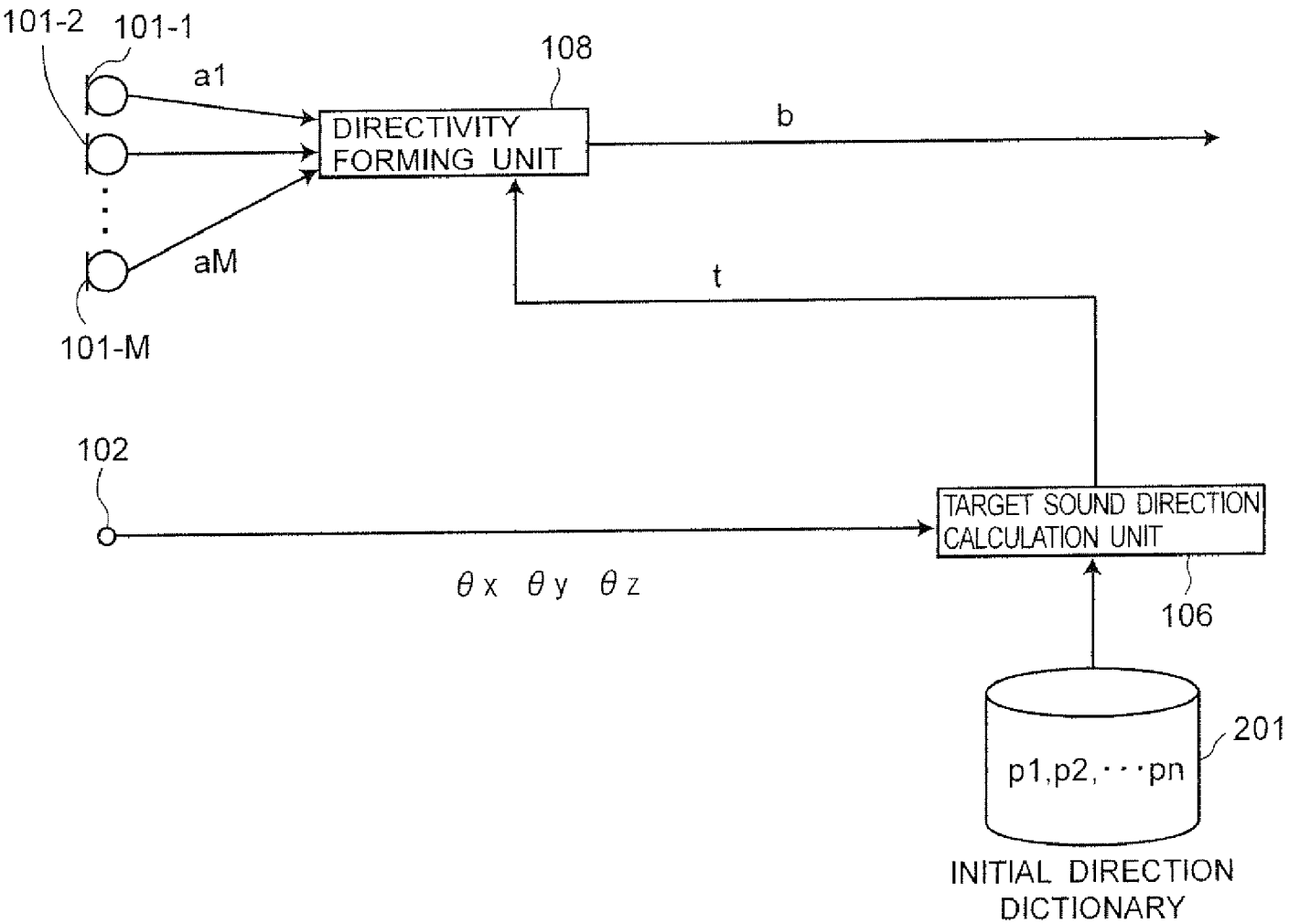
FIG. 5 is a block diagram of the sound receiving apparatus according to a fifth embodiment.

Next, the sound receiving apparatus 100 of the fifth embodiment is explained by referring to FIGS. 5 and 10. FIG. 5 is a block diagram of the sound receiving apparatus 100 according to the fifth embodiment. In the fifth embodiment, the input terminal 103 and the orientation information memory 104 of the fourth embodiment are removed. In the fifth embodiment, an initial direction is selected according to orientation (changing hourly) of the equipment body 105 of the sound receiving apparatus 100. The initial direction is used as a directivity direction.

Figure 10B:
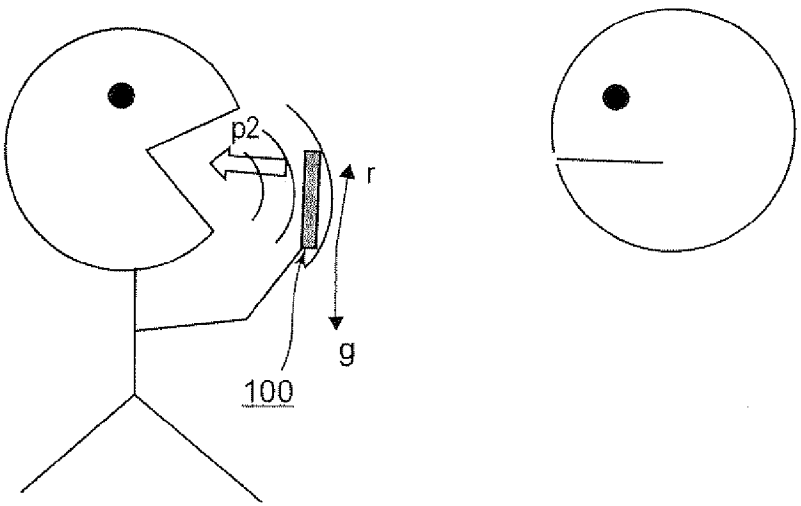
FIGS. 10A and 10B are schematic diagrams showing use status of the sound receiving apparatus according to the fifth embodiment.
Figure 10A:
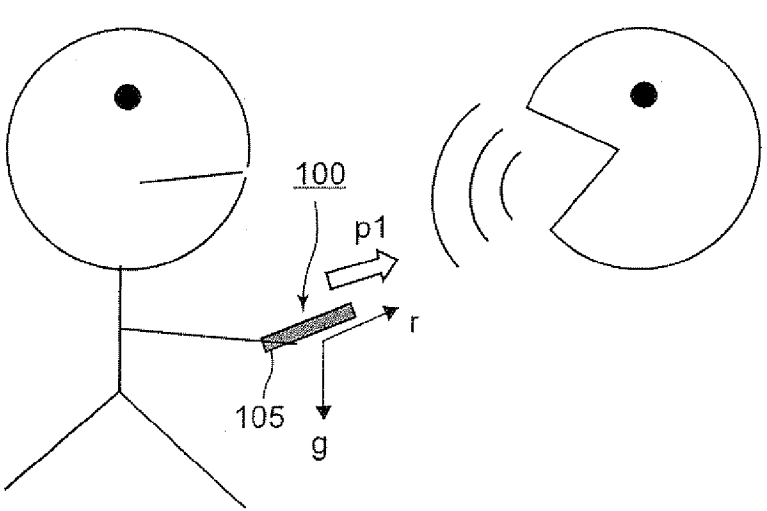

For example, in case that the sound receiving apparatus 100 is applied to a speech translation apparatus (explained as a sixth embodiment afterwards), operator of the sound receiving apparatus 100 talks with an opposite speaker via the sound receiving apparatus 100. As shown in FIG. 10B, when the operator inputs voice to the sound receiving apparatus 100, the operator holds the equipment body 105 in his hand. As shown in FIG. 10A, when the opposite speaker input voice to the sound receiving apparatus 100, the operator lays down the equipment body 105.

In this way, if a target sound direction closely relates to an operational angle of the equipment body 105, input of lock information is not necessary. A directivity direction can be changed by orientation of the equipment body 105. For example, by using a gravity-acceleration sensor of three axes, a gravity-acceleration direction (a lower direction) can be detected.

As shown in FIG. 10A, if an angle between the lower direction (vector g) and a long side direction (vector r) of the equipment body 105 is below a threshold, an initial direction p1 (preset along the long side direction of the equipment body 105) is selected to turn a directivity direction to the opposite speaker's voice. On the other hand, as shown in FIG. 10B, if the angle is above the threshold, an initial direction p2 (preset along a normal line direction to the long side direction) is selected.

Under this component, an operator can change a directivity by movement of the equipment body 105 of the sound receiving apparatus 100. Accordingly, the operator can smoothly use the sound receiving apparatus 100.

Sixth Embodiment

Figure 12:
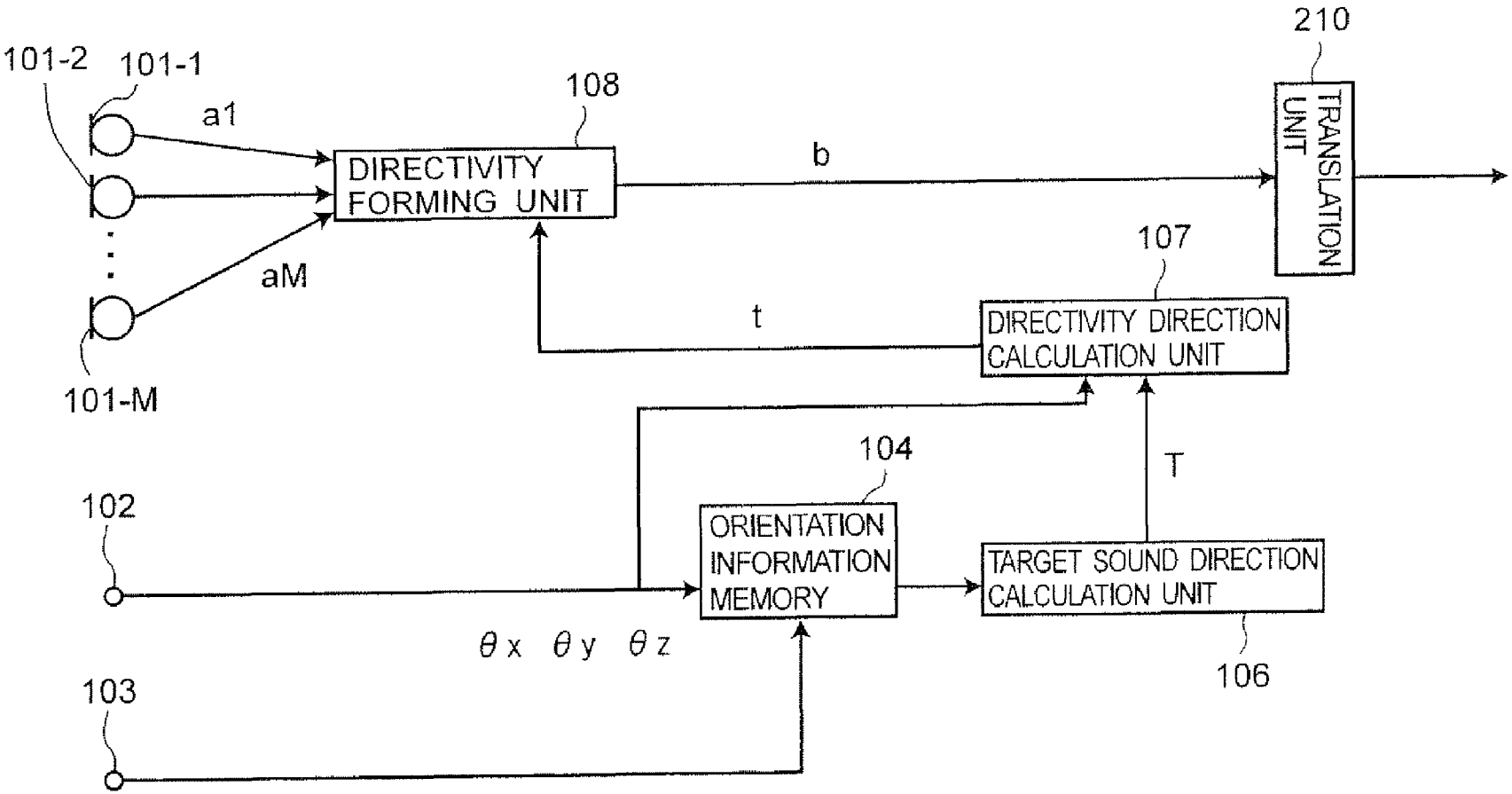
FIG. 12 is a block diagram of the sound receiving apparatus according to a sixth embodiment.

Next, a translation apparatus 200 of the sixth embodiment is explained by referring to FIGS. 7A and 12. In the sixth embodiment, the sound receiving apparatus 100 of the first embodiment is applied to a translation apparatus.

FIG. 12 is a block diagram of the translation apparatus 200. In FIG. 12, a translation unit 210 translates speech emphasized along a directivity direction (output from the sound receiving apparatus 100) to a predetermined language (For example, from English to Japanese). In this case, as shown in FIG. 7A, an operator locks an initial direction (target sound direction) of the equipment body 105. The sound receiving apparatus 100 picks up an English speech from an opposite speaker. The translation unit 210 translates the English speech to a Japanese speech, and replays or displays the Japanese speech.

Modification Example

In above embodiments, a microphone is used as a speech input means. However, various means for inputting speech are applicable. For example, a signal previously recorded may be replayed and input. Furthermore, a signal generated by calculation simulation may be used. Briefly, the speech input means is not limited to the microphone.

In the disclosed embodiments, the processing can be accomplished by a computer-executable program, and this program can be realized in a computer-readable memory device.

In the embodiments, the memory device, such as a magnetic disk, a flexible disk, a hard disk, an optical disk (CD-ROM, CD-R, DVD, and so on), an optical magnetic disk (MD and so on) can be used to store instructions for causing a processor or a computer to perform the processes described above.

Furthermore, based on an indication of the program installed from the memory device to the computer, OS (operation system) operating on the computer, or MW (middle ware software), such as database management software or network, may execute one part of each processing to realize the embodiments.

Furthermore, the memory device is not limited to a device independent from the computer. By downloading a program transmitted through a LAN or the Internet, a memory device in which the program is stored is included. Furthermore, the memory device is not limited to one. In the case that the processing of the embodiments is executed by a plurality of memory devices, a plurality of memory devices may be included in the memory device. The component of the device may be arbitrarily composed.

A computer may execute each processing stage of the embodiments according to the program stored in the memory device. The computer may be one apparatus such as a personal computer or a system in which a plurality of processing apparatuses are connected through a network. Furthermore, the computer is not limited to a personal computer. Those skilled in the art will appreciate that a computer includes a processing unit in an information processor, a microcomputer, and so on. In short, the equipment and the apparatus that can execute the functions in embodiments using the program are generally called the computer.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. An apparatus for receiving sound, comprising:

an equipment body;

a plurality of sound receiving units in the equipment body;

an initial information memory configured to store an initial direction of the equipment body in a terminal coordinate system based on the equipment body;

an orientation detection unit configured to detect an orientation of the equipment body in a world coordinate system based on a real space;

a lock information output unit configured to output lock information representing to lock the orientation;

an orientation information memory configured to store the orientation detected when the lock information is output;

a direction conversion unit configured to convert the initial direction to a target sound direction in the world coordinate system by using the orientation stored in the orientation information memory; and a directivity forming unit configured to form a directivity of the plurality of sound receiving units toward the target sound direction.

2. The apparatus according to claim 1, wherein the initial information memory stores a plurality of initial directions each differently preset on the equipment body, and further comprising:

a direction selection unit configured to select one of the plurality of initial directions according to the orientation.

3. The apparatus according to claim 1, wherein the initial information memory stores an initial range preset around the equipment body; and further comprising:

a sound source direction detection unit configured to detect a sound source direction toward a sound receiving object; and a decision unit configured to set the sound source direction as the initial direction when the sound source direction is within the initial range.

4. The apparatus according to claim 3 wherein the initial range information memory further stores a plurality of initial ranges each differently preset around the equipment body, and further comprising:

a range selection unit configured to select one of the plurality of initial ranges according to the orientation.

5. The apparatus according to claim 1, wherein the directivity forming unit forms the directivity to the initial direction.

6. The apparatus according to claim 1, wherein the lock information output unit outputs the lock information when the equipment body postures at predetermined orientation.

7. The apparatus according to claim 1, wherein the lock information output unit outputs the lock information at a start timing of a user's utterance.

8. The apparatus according to claim 1, wherein the directivity forming unit forms a directivity as a tracking range including the target sound direction.

9. The apparatus according to claim 1, wherein the directivity forming unit selects at least one from the plurality of sound receiving units, the at least one being able to receive a sound from the target sound direction by higher sensitivity.

10. A method for receiving sound in an equipment body having a plurality of sound receiving units, comprising:

storing an initial direction of the equipment body in a terminal coordinate system based on the equipment body;

detecting an orientation of the equipment body in a world coordinate system based on a real space;

outputting lock information representing to lock the orientation;

storing the orientation detected when the lock information is output;

converting the initial direction to a target sound direction in the world coordinate system by using the orientation stored; and forming a directivity of the plurality of sound receiving units toward the target sound direction.

11. The method according to claim 10, further comprising:

storing a plurality of initial directions each differently preset on the equipment body; and selecting one of the plurality of initial directions according to the orientation.

12. The method according to claim 10, further comprising:

storing an initial range preset around the equipment body;

detecting a sound source direction toward a sound receiving object; and setting the sound source direction as the initial direction when the sound source direction is within the initial range.

13. The method according to claim 12, further comprising:

storing a plurality of initial ranges each differently preset around the equipment body; and selecting one of the plurality of initial ranges according to the orientation.

14. The method according to claim 10, wherein the forming includes forming the directivity to the initial direction.

15. The method according to claim 10, wherein the outputting includes outputting the lock information when the equipment body postures at predetermined orientation.

16. The method according to claim 10, wherein the outputting includes outputting the lock information at a start timing of a user's utterance.

17. The method according to claim 10, wherein the forming includes forming a directivity as a tracking range including the target sound direction.

18. The method according to claim 10, wherein the forming includes selecting at least one of the plurality of sound receiving units, the at least one being able to receive a sound from the target sound direction by higher sensitivity.

* * * * *